United States Patent [19]

Kamberg

[11] Patent Number: 4,677,773

[45] Date of Patent: Jul. 7, 1987

[54] HEATED ROTARY FLATWORK IRONER

[75] Inventor: Eduard Kamberg, Chicago, Ill.

[73] Assignee: New Super Laundry Machinery Co. Inc., Ill.

[21] Appl. No.: 811,356

[22] Filed: Dec. 20, 1985

[51] Int. Cl.[4] ..... D06F 67/02

[52] U.S. Cl. ..... 38/44; 34/48; 34/124; 100/93 RP; 165/90; 374/153; 432/60; 432/228

[58] Field of Search ..... 38/52, 44; 100/93 RP, 100/157; 165/90; 34/124, 48; 432/60, 222, 228; 236/1 R; 374/153, 154

[56] References Cited

U.S. PATENT DOCUMENTS

| | | | |
|---|---|---|---|
| 1,871,325 | 8/1932 | Keen | 100/93 RP |
| 2,362,947 | 11/1944 | Sullivan | 34/124 X |
| 4,418,486 | 12/1983 | Kober | 38/44 X |
| 4,485,573 | 12/1984 | Kamberg | 38/44 |
| 4,562,655 | 1/1986 | Bosshart et al. | 34/124 X |

*Primary Examiner*—Werner H. Schroeder
*Assistant Examiner*—Andrew M. Falik

[57] ABSTRACT

A rotary cylindrical drum used in a commercial laundry flatwork finisher, having a jacket type construction so as to provide an annular fluid cavity for uniformly heating the exposed surface of the drum. The flatwork finisher includes fluid circulating system providing a temperature sensing probe exteriorly of the drum for measuring and regulating the temperature of the circulated fuel by controlling the operation of a heating element associated therewith.

8 Claims, 3 Drawing Figures

HEATED ROTARY FLATWORK IRONER

BACKGROUND OF THE INVENTION

Prior endeavors have been made to accurately sense and control the heated surface of a rotary drum type flatwork ironer. These past devices included mechanical contact between a temperature sensing unit with the surface of the drum. This arrangement inherently created undesirable problems, causing use disruption, when the flatwork being processed would become entangled in the mechanical assembly.

Still other problems resulted when foreign matter lodges between a temperature probe and the drum surface thus producing wide variances in temperatures. It was also found that any physical contact whether external or internally with the surface of the drum would cause excess wear and maintenance in addition to producing unreliable indicated temperatures across the full surface of the drum.

It has likewise been proven impractical to insert a stationary temperature probe within a sealed fluid cavity of a jacketed drum. This was unsatisfactory as once the contained fluid expanded during heating, such expanded fluid would not reflect a true temperature reading over the entire drum surfaces but rather produced a variation in the heated areas.

SUMMARY OF THE INVENTION

This invention relates to a new and novel arrangement for evenly heating and maintaining the temperature of the exterior cylindrical surface of a flatwork ironer.

To accomplish this end the device provides a closed fluid cavity in communication with a fluid flow system. The fluid within the cavity is heated by an internal heat source within a cylindrical ironer drum and the captured fluid is recirculated by a pump positioned externally of the cylinder drum. A heat sensor controls the recirculation of the fluid into and out of the fluid cavity as well as the operation of the heat source. A fluid collecting tank as well as an overflow tank are in the fluid flow system and cooperate with the heat source and circulating pump to maintain the fluid temperature within a desired operational range.

It is the object of this invention to provide a fluid heated drum wherein the fluid is circulated within the jacketed drum while moving over an external temperature probe that determines and maintains a uniform temperature of the drum heating fluid by controlling the operation of a heating unit for the fluid.

Another object of the invention is to provide a fluid temperature probe which will control a fluid heating element as well as a fluid circulating means. By this arrangement the temperature of the fluid circulated into the jacketed drum will be continuously circulated when it is being heated, so as to maintain a constant uniform heating medium reacting upon the working surface of the drum.

A further object of the invention is to provide a drum heating fluid circulating means, a temperature controlled heating and circulating means which includes a fluid accumulator and expansion tank. The expansion tank will receive the excess fluid caused by the fluid's expansion, due to its rising temperature, and an accumulator tank wherein fluid may be received and cooled so as not to destroy its viscosity and temperature retaining characteristics.

Other objects will appear hereinafter.

BRIEF DESCRIPTION OF THE DRAWINGS

The invention will be best understood by reference to the accompanying drawings which disclose the preferred construction and mode of operation by which the stated objects of the invention are achieved, and in which.

GENERAL DESCRIPTION

This invention while preferably involving a commercial laundry flatwork finisher which incorporates a rotary drum having uniformly heated cylindrical surface may be utilized in other commercial endeavors requiring the construction and mode of operation hereinafter described and claimed.

Figure 1:
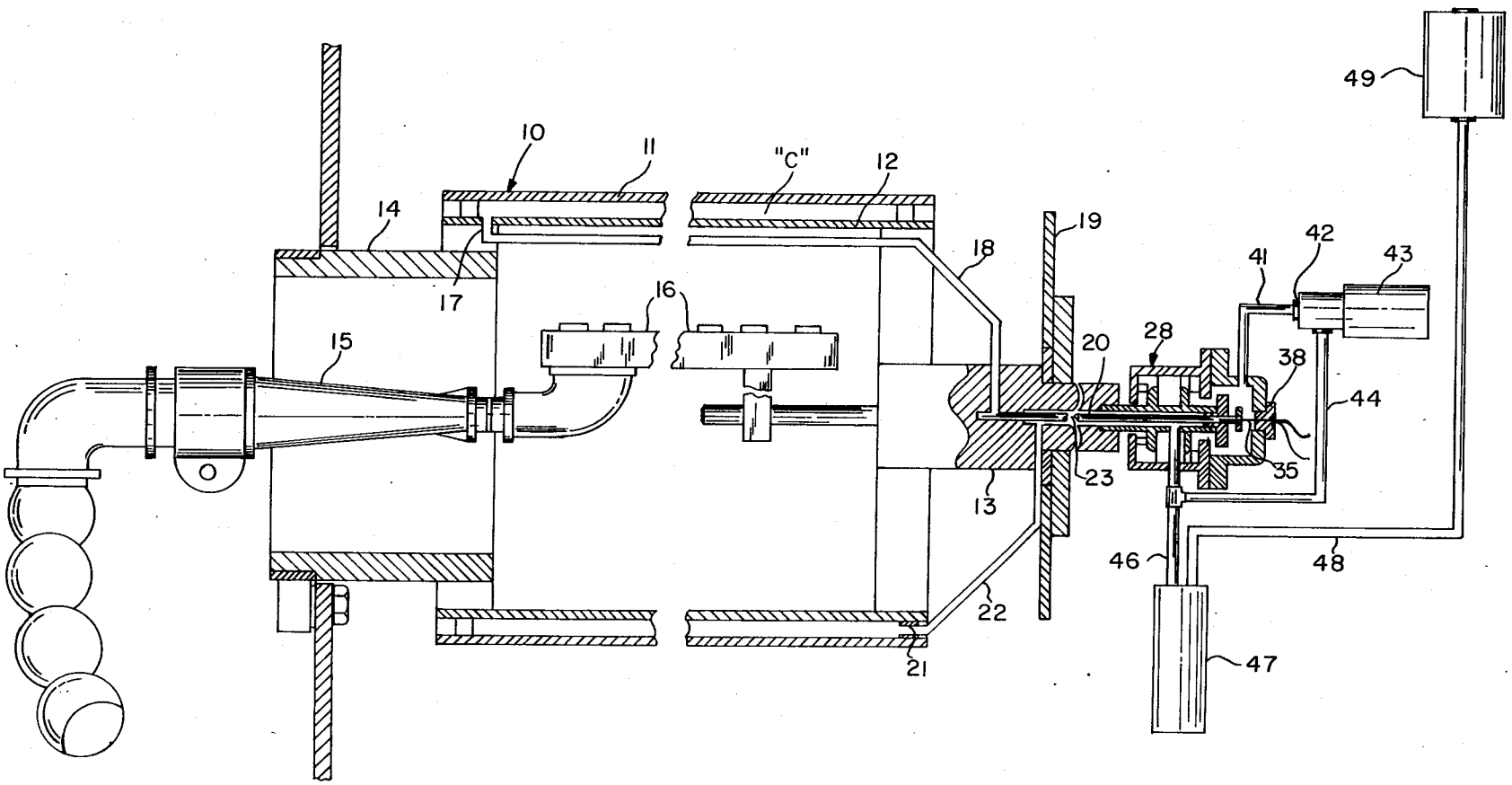
FIG. 1 is a fragmentary detailed sectional schematic view of the invention.
Figure 2:
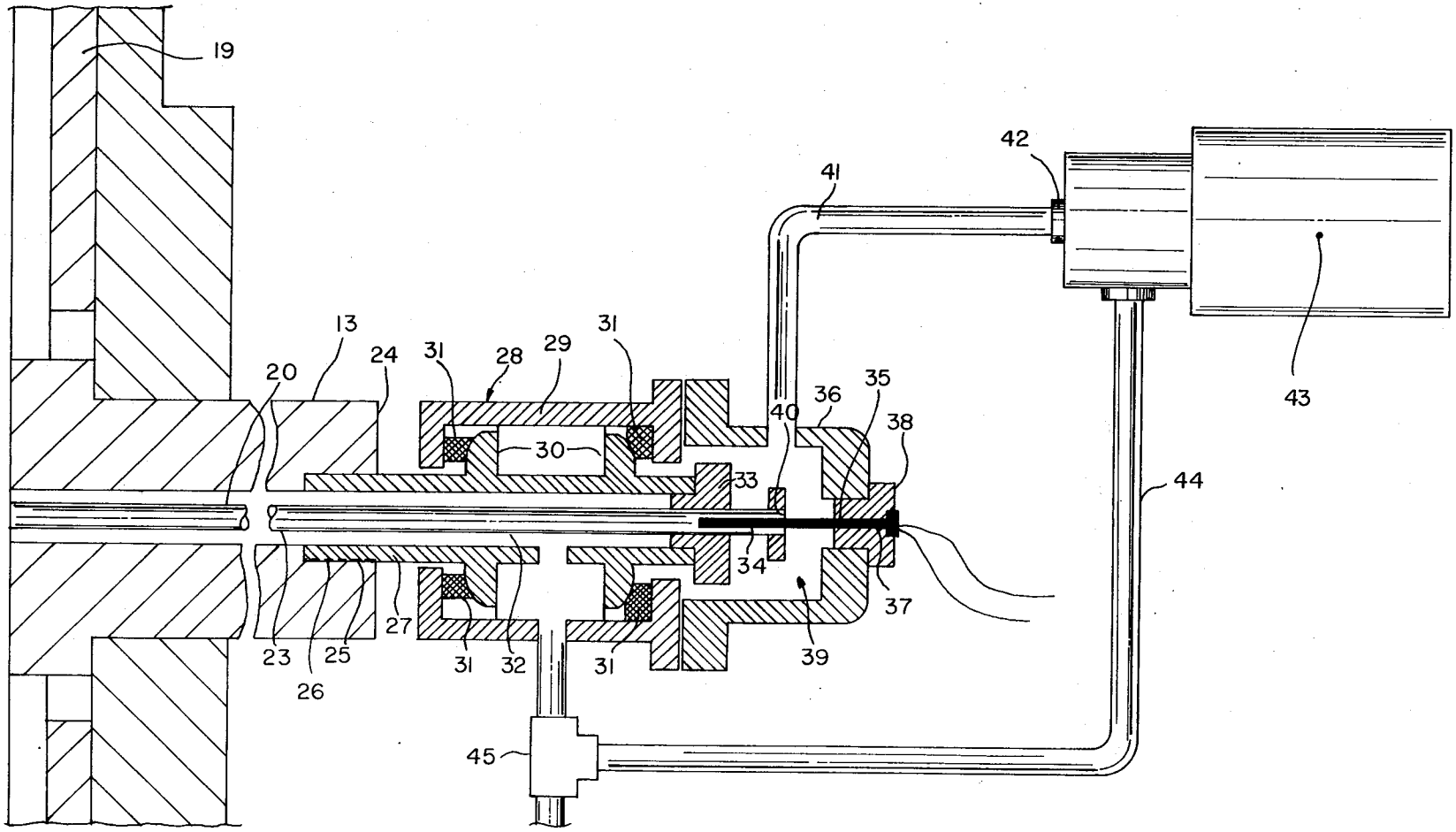
FIG. 2 is a fragmentary detailed sectional enlargement of the flow passage embodied in this invention.

The flatwork finisher normally includes a rotating heated roller or drum 10. As shown in FIG. 1 the drum 10 includes an outer cylindrical polished work surface 11 and a spaced inner cylindrical wall 12 forming therebetween a fluid cavity "C". The drum 10 is carried by axially aligned supporting shafts 13 and 14 with the shaft 14 being hollow to accomodate a conduit 15 for combustible fuel for the heating element 16 fixedly positioned within the hollow interior of the drum 10. The construction of the drum 10 as well as its internal element and rotable supports may be of the construction shown and described in U.S. Pat. No. 4,485,573.

As shown the fluid cavity "C" has at one distal end a fluid inlet 17 that by a suitable conduit 18 which extends through the one end wall 19 and into the axial shaft 13 has communication with a fluid supply tube 20. The proximal edge of the cavity "C" is provided with an exhaust port 21 which by a suitable conduit 22 has communication with an internal bore 23 formed in the axial shaft 13.

As shown the free end 24 of the shaft 13 is provided with a counter bore 25 which frictionally receives the insert end 26 of the hollow connecting shaft 27 of a rotary union 28.

This rotary union 28 includes a circular housing 29 that encloses the spaced circular flanges 30 formed on the periphery of the shaft 27, and by suitable seals 31, hydraulically seal the connection between the housing 28 and shaft 27, while permitting axial rotation of the shaft 27 with the drum shaft 14. It should be noted that the internal bore 23 formed in the axial shaft 14 mates with and continues through the center bore 32 of the shaft 27. Likewise the free standing fluid supply tube 20 extends through the shaft 27 and is held therein by an end closure 33 which end closure 33 also seals the end of the center bore 32.

A stem 34 of a heat sensing probe 35 is inserted into the open end of the tube 20. An end cap 36 is attached to the housing 29 and has an axial opening 37 normally closed by a plug 38 that in turn supports the heat sensing probe 35 as shown.

The end cap 36 forms an interior annular chamber 39 into which the open end 40 of the fluid supply 20 projects. By a conduit 41 the chamber 39, as well as the open end of the tube 20, has communication with the outlet port 42 of the circulating pump 43.

The circulating pump 43 by a conduit 44 is in communication with the center bore 32 of the shaft 27 a well as the internal bore 23 of the shaft 14.

By a T joint 45, in the conduit 44, and through a connecting conduit 46, a cooling tank 47 is included in the flow path of the circulating fluid. The cooling tank 47 by a conduit 48 has open communication with an expansion tank 49.

The operation of the apparatus requires that the complete circulating system of the heating fluid be filled with the exception of the expansion tank 49.

When the machine is turned on the temperature of the fulid in the system will normally be below the desired temperature needed to heat the working surface of the drum 10. This temperature will be sensed by the probe 34 which will in turn cause the automatic ignition of the heater 16 within the drum 10, in a manner well known in the art. Simultaneously the circulating pump 43 will be energized and this will commence a fluid flow out of its outlet port 42 through conduit 41 into the chamber 39 about the temperature probe 34 and into the open end 40 of the fluid supply tube 20. The fluid is then caused to pass through conduit 18 into the fluid inlet 17 and through the fluid cavity "C". The fluid will then be caused to exit the cavity "C" through the exhaust port 21 through the conduit 22 and into the internal bores 23 and 32 formed in the axial shaft 14 and the connecting shaft 27 of the rotary union 28. The exhausted fluid will exit the rotary union 28 through a port and into conduit 44, and back to the pump 43. The return fluid will during its initial expansion caused by its heating have an increased volume which will pass through conduit 46 into the cooling tank 47. As the fluid is continuously circulated and heated a certain volume of it will be caused to enter the expansion tank 49 thus preventing any possible blow out of the system.

As it is desirable to utilize a "heavy fluid", such as an oil composition, it is necessary to control its temperature during its return circulation. Thus the cooling tank 47 will normally receive fluids heated to a temperature of over 200° F. and retain the same until such temperature is lowered to a desired degree before it will be continuously recirculated past the burner 16.

In normal operation the fluid temperature will be in the range between 200 and 300 degrees and in the event that the temperature surpasses the maximum setting the temperature probe 34 will deactivate the burner 16 without interrupting the operation of the circulating pump 43.

Figure 3:
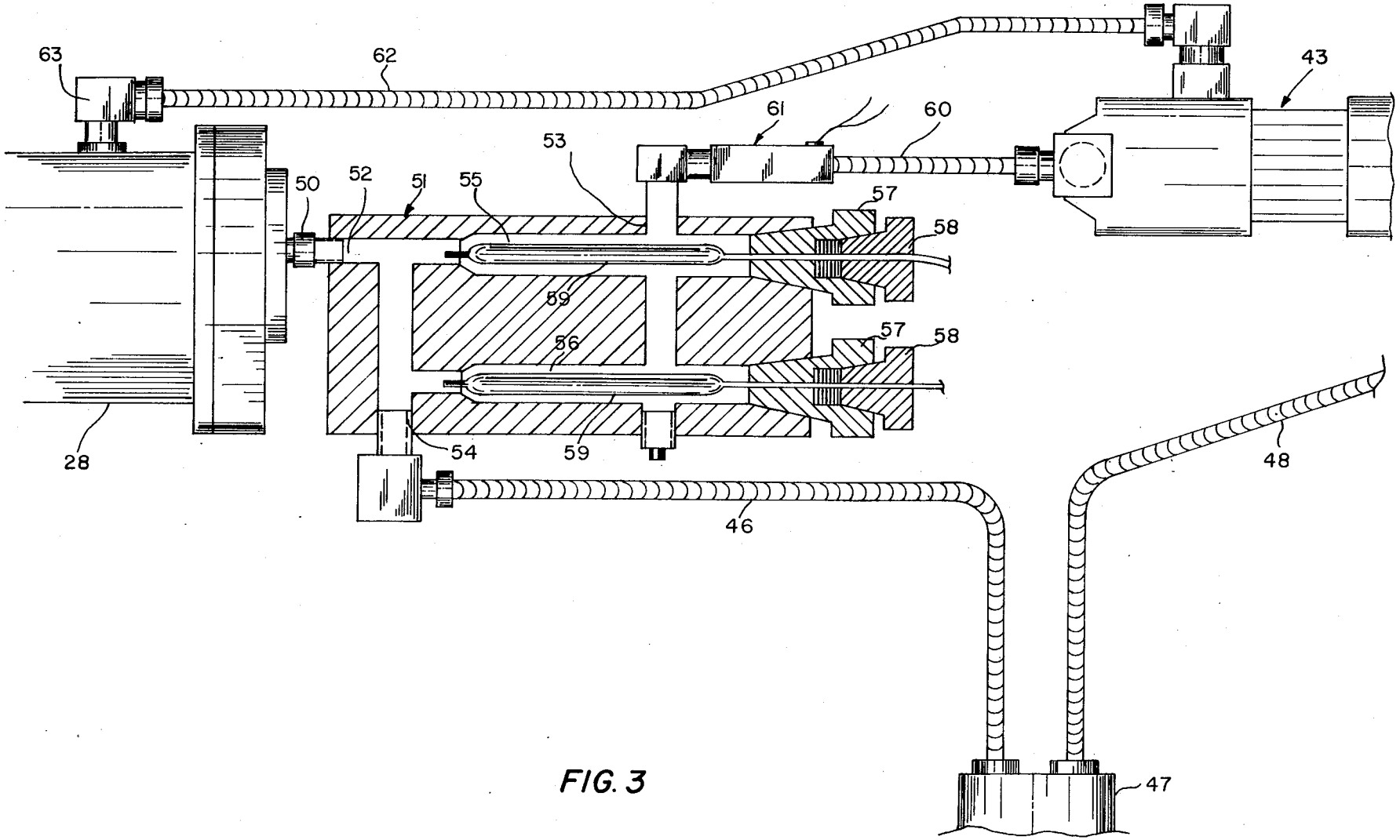
FIG. 3 is a fragmentary detailed sectional schematic view of a modified form of the invention.

In FIG. 3 there is disclosed a modified temperature control system. The modified system includes the rotary union 28, and circulating pump 43 as previously described. This system includes an exhaust conduit 50 running from the union 28 into a manifold 51. The manifold 51 includes an inlet port 52 and exhaust ports 53 and 54, as well as fluid passages 55 and 56 that have corresponding ends in communication with the inlet 52, while their opposite ends are closed by suitable plugs 57.

As shown each plug 57 supports a removable carrier 58 which in turn supports a thermostat 59, that are disposed axially in the fluid passages 55 and 56.

The exhaust port 53 is in communication with a conduit 60 which houses a flow switch 61. This conduit 60 is in communication with a circulating pump like the one shown in FIG. 1 and includes a return conduit 62 projected through a suitable coupling 63 so as to provide communication with the rotary union 28 and rotating drum 10 as hereinbefore described.

The purpose of the double thermostats 59 is a safety back up. One of the thermostats 59 will normally be actuated so as to deactivate the burner within a fluid temperature range of 200 to 400 degrees. The back up thermostat will deactivate the system upon failure of the flat thermostat and when the fluid temperature exceeds 420 degrees.

As it is a required condition that the circulating pump be operating before the burner ignition can start, it is imparative there be a supply of fluid to such pump. For this reason a flow switch 61, which under presence of fluid is normally closed, is included in the safety circuit. In the event that the flow switch 61 opens due to lack of fluid it will disrupt the complete operation of the apparatus.

From the foregoing it is apparent that I have described a heating and temperature control apparatus which overcomes the objections of the prior devices and assures an even and controlled temperature to the working surface of the rotatable drum. With the system described the circulating pump must operate whenever the burner is on. The heat transfer fluid is siphoned out of the cavity of the heated drum at the end closest to the rotary union, and pumped back over the probe into the far end of the cavity. This circulating fluid over the probe provides an accurate temperature indication of the heated drum. In addition to the accurate temperature control of the heated drum the pumped fluid adds to the circulation of the heated fluid within the drum creating a more even heat distribution therethrough.

While I have illustrated and described the preferred form of construction for carrying my invention into effect, this is capable of variation and modification without departing from the spirit of the invention. I therefore, do not wish to be limited to the precise details of construction as set forth, but desire to avail byself of such variations and modifications as come within the scope of the appended claims.

Having thus described the invention what I claim as new and desire to protect by Letters Patent is;

1. A heated rotary flatwork finisher comprising:

(a) a drum having a double wall construction providing a closed annular fluid cavity, (b) means supporting said drum for rotation about its horizontal axis, (c) a fluid inlet port for said cavity at the remote end of said drum and a fluid exhaust port for said cavity at the opposite end of said drum, (d) a stationary ignitable heat source within said drum for heating the fluid in said cavity so as to provide an optimum heat transfer to the outer wall of the double walled drum, (e) a fluid flow system including said inlet and exhaust ports and means having communication through said supporting means for recirculating the fluid into said fluid cavity through said inlet port at the remote end of said drum and out of said cavity through said exhaust port, (f) means exteriorly of said drum and in a portion of said fluid flow system and in the path of the recirculating fluid for sensing the temperature of such recirculating fluid and responsive to a predetermined temperature thereof for controlling the simultaneous ignition of said heat source and said means for recirculating the fluid through said fluid cavity, and (g) means for sensing the presence of fluid in said fluid flow systems.

2. A heated rotary flatwork finisher as defined by claim 1 wherein said means for circulating a fluid through said fluid cavity comprises a circulating pump.

3. A heated rotary flatwork finisher as defined claim 2 wherein said means for sensing the temperature of the circulating fluid is a thermostat disposed in the path of said circulated fluid as it is circulated by said pump through said inlet port into said fluid cavity of said drum.

4. A heated roarty flatwork finisher as defined by claim 3 including an expansion tank in the flow of fluid from said fluid cavity through said exhaust port by said circulating pump.

5. A heated rotary flatwork finisher as defined by claim 1 wherein said means for sensing the temperature of the circulating fluid comprises a thermostat disposed in the path of said circulating fluid as it is caused to flow through said inlet port into said fluid cavity of said drum.

6. A heated rotary flatwork finisher as defined by claim 1 including an expansion tank in the flow of fluid from said fluid cavity through said exhaust port by said circulating means.

7. A heated rotary flatwork finisher as defined by claim 6 wherein said means for circulating a fluid through said fluid cavity comprises a circulating pump.

8. A heated rotary flatwork finisher as defined by claim 6 wherein said means for sensing the temperature of the circulating fluid comprises a thermostat disposed in the path of said circulating fluid as it it caused to flow through said inlet port into said fluid cavity of said drum.

* * * * *